US011174780B1

(12) United States Patent
Conway et al.

(10) Patent No.: US 11,174,780 B1
(45) Date of Patent: Nov. 16, 2021

(54) MICROWAVE HEATING OF COMBUSTION CHAMBER OF INTERNAL COMBUSTION ENGINE DURING COLD STARTING

(71) Applicant: Southwest Research Institute, San Antonio, TX (US)

(72) Inventors: Graham T Conway, San Antonio, TX (US); Yilun Luo, Ann Arbor, MI (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 17/177,221

(22) Filed: Feb. 17, 2021

(51) Int. Cl.
*F02M 27/08* (2006.01)
*F02B 51/00* (2006.01)

(52) U.S. Cl.
CPC ..... *F02B 51/00* (2013.01)

(58) Field of Classification Search
CPC ..... F02M 27/04; F02M 27/042; F02M 27/06; F02M 27/065; F02M 27/08; F02M 2027/047; F02B 51/00
USPC ..... 123/685, 491, 536; 701/113
See application file for complete search history.

(56) References Cited

U.S. PATENT DOCUMENTS

| | | | | |
|---|---|---|---|---|
| 8,156,911 | B2 * | 4/2012 | Ikeda | F02B 23/0657 123/143 B |
| 9,693,442 | B2 * | 6/2017 | Ikeda | H01T 13/50 |
| 10,677,456 | B2 * | 6/2020 | Luo | H01Q 1/3208 |
| 2012/0097140 | A1 * | 4/2012 | Kusunoki | H01T 13/32 123/620 |

* cited by examiner

*Primary Examiner* — Hai H Huynh
(74) *Attorney, Agent, or Firm* — Livingston Law Firm

(57) ABSTRACT

A method of improving cold starting of an internal combustion engine of a vehicle. The vehicle is equipped with an on-board microwave generation system that generates and delivers microwaves into the combustion chamber of each cylinder via an antenna associated with each cylinder. The microwaves are delivered immediately prior to cold start of the engine, causing the combustion chamber and interior elements of the chamber to be warmed.

10 Claims, 3 Drawing Sheets

MICROWAVE HEATING OF COMBUSTION CHAMBER OF INTERNAL COMBUSTION ENGINE DURING COLD STARTING

TECHNICAL FIELD OF THE INVENTION

This invention relates to internal combustion engines, and more particularly to improving combustion by pre-heating the combustion chamber using microwaves.

BACKGROUND OF THE INVENTION

Internal combustion engines tend to have sub-optimal combustion in cold-starting conditions. The cold combustion chamber quenches the ignition flame, which causes an increase in carbon monoxide and hydrocarbon emissions. If the fuel injection tip is cold, this will increase the likelihood of particulate matter emissions.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to using microwave energy to heat the combustion chamber of the cylinders of an internal combustion engine. During cold start conditions, microwave energy is coupled to the chamber volume via an antenna. This heats the chamber surfaces, aiding in proper combustion.

Figure 1:
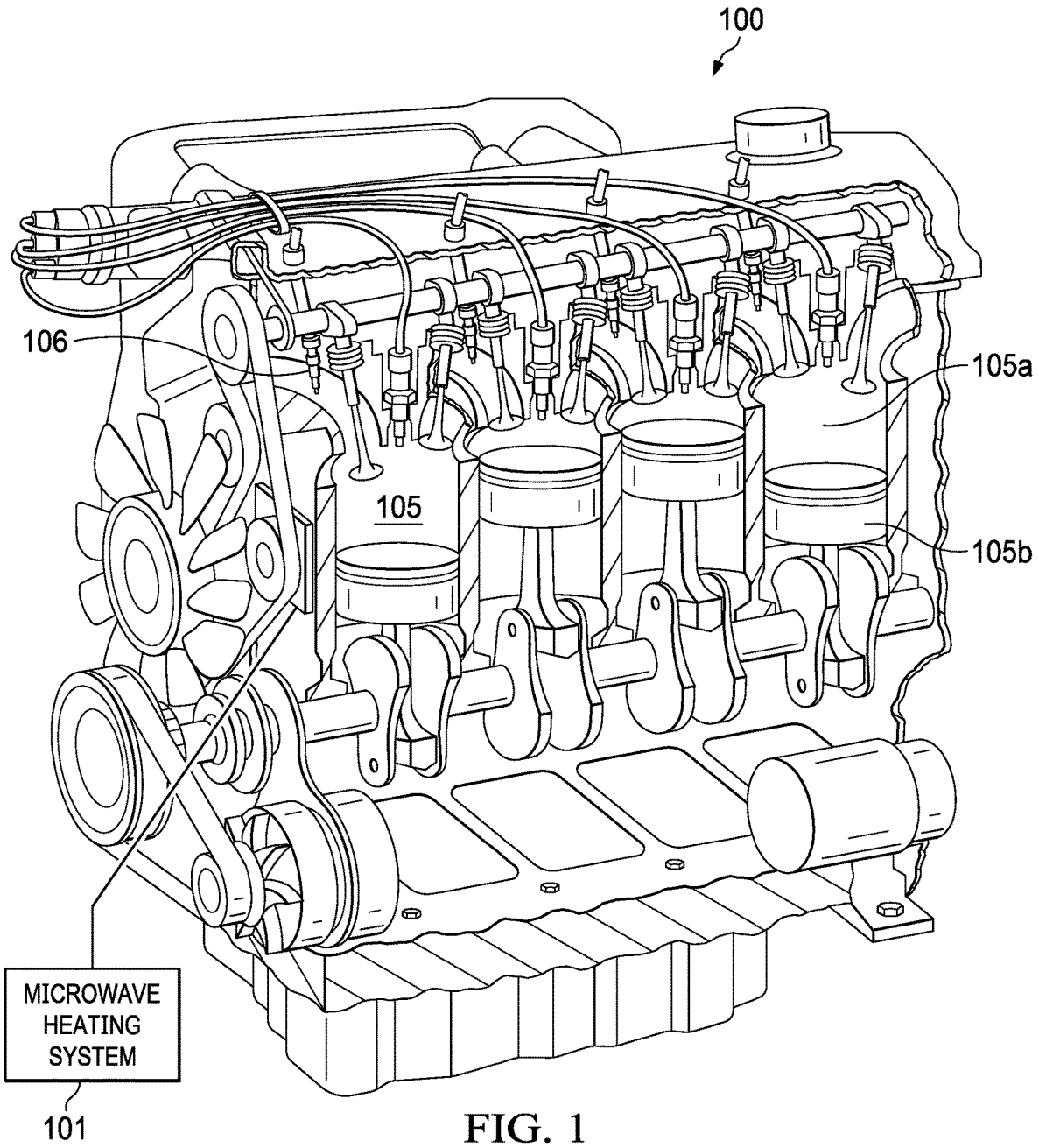
FIG. 1 illustrates an internal combustion engine having a microwave heating system for heating the combustion chambers of the cylinders.

FIG. 1 illustrates an internal combustion engine 100 having a microwave heating system 101 in accordance with the invention. Application of the invention described herein is expected to be typically for vehicle engines, with the microwave heating system 101 being on-board the vehicle.

Engine 100 has a number of cylinders 105, each having a combustion chamber 105*a* and a reciprocating piston 105*b*. The volume of the combustion chamber 105*a* changes as the piston 105*b* moves. Where engine 100 is a four-stroke engine, during its compression stroke intake and exhaust valves are closed and the piston moves upward reducing the combustion chamber volume which reaches its minimum when the piston is at TDC (top dead center). Just before the piston reaches TDC, ignition begins.

A fuel injector 106 has an injector nozzle within the combustion chamber. If the tip of the injector nozzle is cold during engine start-up, undesired engine emissions may occur.

A microwave heating system 101 is equipped to deliver microwave energy into each combustion chamber 105*a*. As stated above, this heats the chamber during cold engine starting events. The heating precedes ignition, typically for a period of at least two seconds prior to ignition and preferably longer. The heating is performed for a duration of time sufficient to heat the combustion chamber such that emissions are reduced. This duration may be experimentally determined or modeled. In addition to emissions reduction, the warmer combustion chamber requires less energy from the starter motor, which in turn improves efficiency and lessens ware on the starter.

Figure 2:
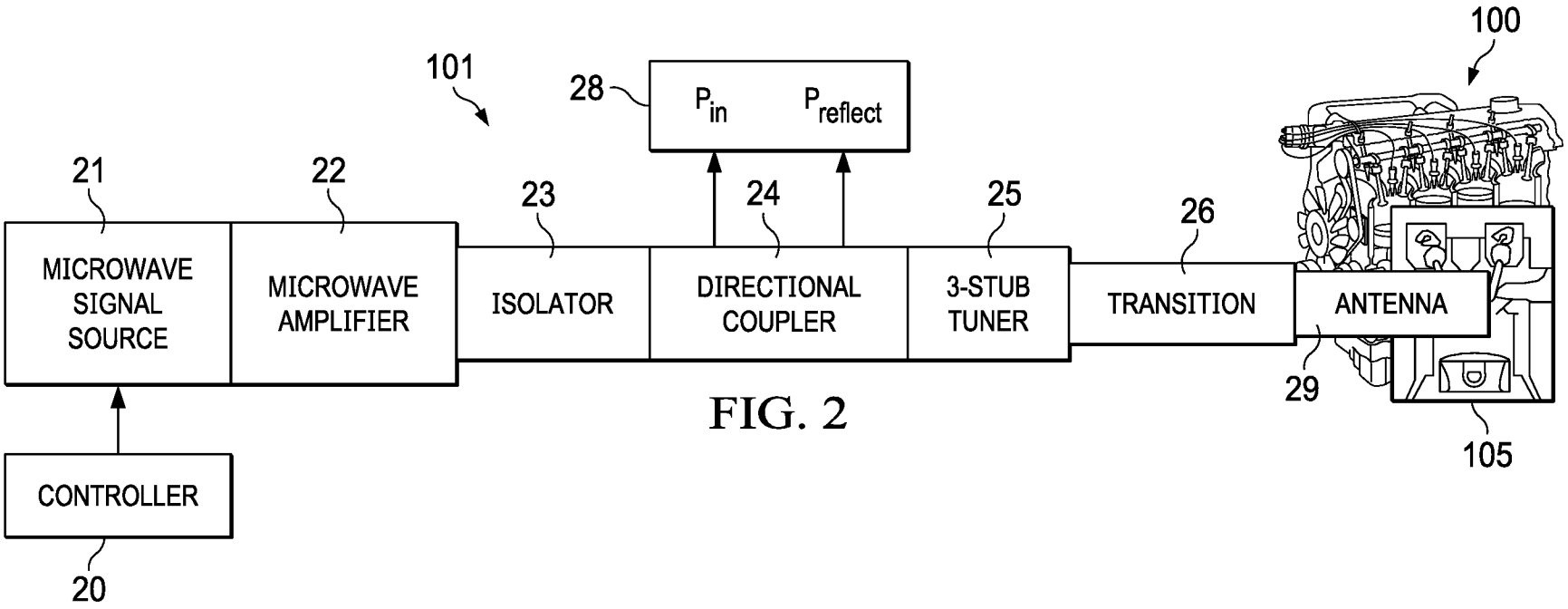
FIG. 2 illustrates the microwave heating system in further detail.

FIG. 2 illustrates the microwave heating system 101 in further detail. As stated above, microwaves are delivered into the combustion chamber 105*a* of each cylinder 105 via a waveguide antenna 29.

Other elements of the microwave heating system 101 are a microwave generator 21, an amplifier 22, an isolator 23, and directional coupler 24, a tuner 25, and a transition coupler 26. A controller 20 has appropriate processing and memory to perform tasks related to microwave generation as described below.

As explained below, in a typical engine, the combustion chamber volumes differ at starting, thus each combustion chamber 105*a* has an associated antenna 29, signal source 21, and intermediate elements.

Microwave generator 21 is the signal source for the microwaves and generates the microwaves at a desired frequency or frequencies. The microwave frequency is tuned to the volume of the combustion chamber 105*a* in the state the engine finds itself when 'off'. Each cylinder 105 is at a different volume when the engine is 'off' and so each cylinder requires a different frequency.

Figure 3:
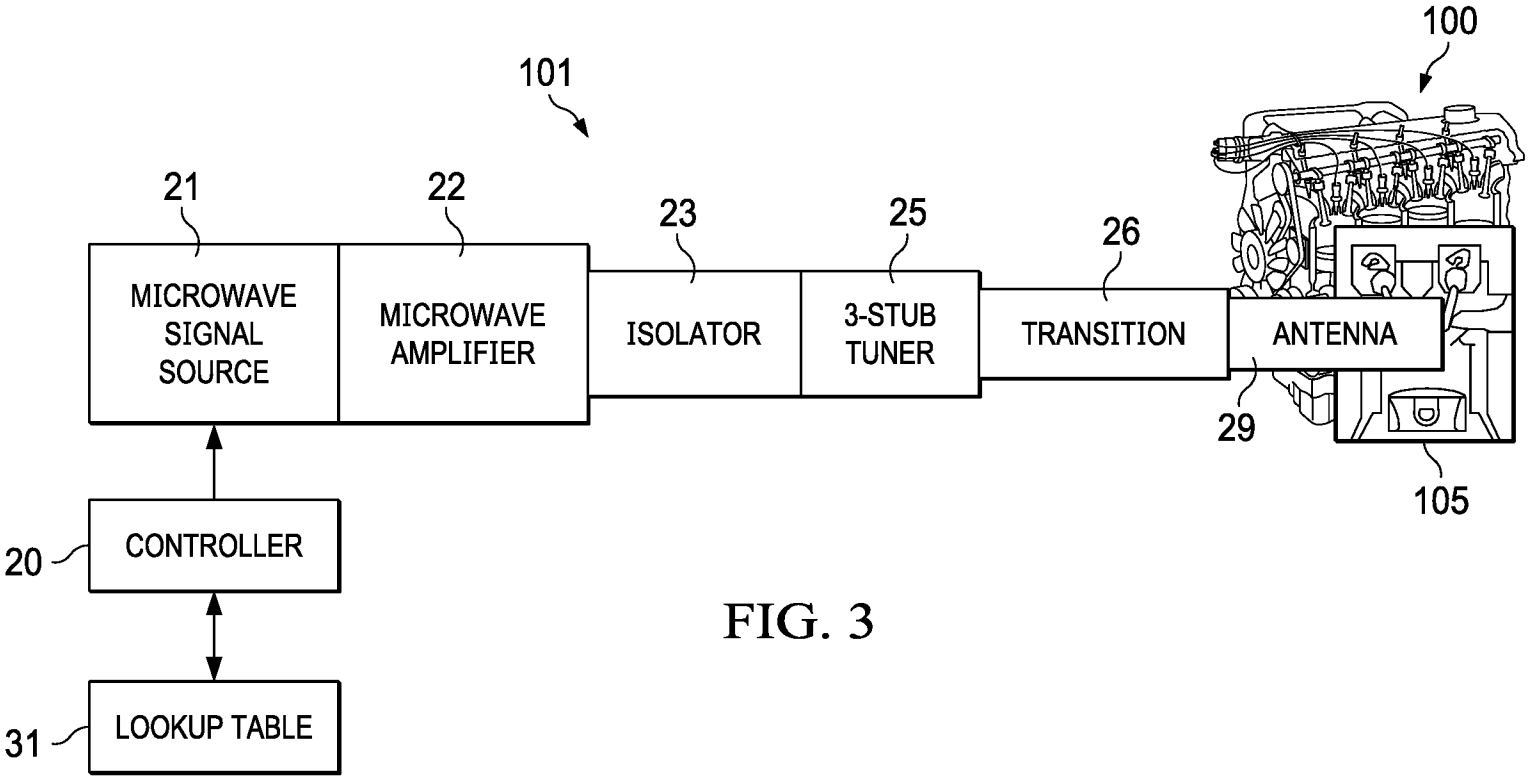
FIG. 3 illustrates an alternative embodiment of the microwave heating system.

In one embodiment, illustrated in FIG. 3, this frequency could be mapped to different volumes. This data is stored in look-up table 31. In operation, controller 20 receives data from the engine 100 that allows controller 20 to track or estimate the cylinder volumes when the engine is off. This data is delivered to look-up table 31. Look-up table 31 maps the volume to a frequency and delivers the appropriate frequency to signal source 21.

Alternatively, as illustrated in FIG. 2, feedback through antenna 29 could be used to identify the best frequency 'on the fly'.

Amplifier 22 amplifies the microwave signal. Isolator 23 is used in a conventional manner to transmit the microwave power in one direction only to shield on its input side, from the effects of conditions on its output side, for example, to prevent a microwave source being detuned by a mismatched load.

Directional coupler 24 samples a small amount of the microwave power for measurement purposes. This permits power meter 28 to measure both the power into the combustion chamber and the reflected power to be measured.

Directional coupler 24 enables system 101 to 'tune' itself on the fly. Amplifier 22 modulates the frequency until a reflected power minima is found. This indicates the best coupling frequency. An advantage of using a power measurement (FIG. 2) versus a look-up table (FIG. 3) to determine frequency is that real-time adjustments can be made as the engine ages.

Three-stub tuner 25 is used in a conventional manner, for load impedance matching. Transition coupler 26 couples antenna 29 to system 101. An antenna 29 is located and configured to deliver microwaves into its associated combustion chamber.

In operation, microwave heating system 101 is activated prior to cold start ignition of engine 100. The microwaves are coupled to the combustion chamber volume, which causes the walls and other elements within the combustion chamber 105*a* to rise in temperature. The elements to be heated may include the cylinder walls, the piston head surface, spark plug, and injector tip.

As stated above, the microwave heating is expected to begin at least two seconds prior to ignition and continue until ignition is achieved.

Microwave system 101 activates when there is a chance of an engine start. Typically, the engine's fuel pump will prime when the vehicle is unlocked after receiving a signal from the BCM (body control module) and the ECU (engine control unit) turns the pump on. This would be an appropriate time/strategy for microwave system 101 to activate. This would give around 5-10 seconds for warming the combustion chambers 105*a* prior to engine start. Whether or not system 101 actually generates microwaves may depend on temperatures around the engine, i.e. only if it is a true cold start (water/oil temp=atmospheric). Controller 20 may be programmed to receive temperature data and to make this determination. The microwave system 101 could still remain on during initial combustion events though its impact will be much lower.

If the vehicle is a hybrid vehicle, other activation strategies are possible. For example, if the vehicle is plugged into an electrical outlet, microwave system 101 could turn on for a short time each hour to maintain a certain temperature. An example of a suitable duration for this periodic activation is thirty seconds.

What is claimed is:

1. A method of improving cold starting of an internal combustion engine of a vehicle, the engine having a number of cylinders, the cylinders having combustion chambers, comprising:

providing a microwave generator on-board the vehicle;

delivering microwaves from the microwave generator into each combustion chamber via an antenna associated with each combustion chamber; and controlling the delivering step such that microwaves are delivered into the combustion chamber immediately prior to cold start of the engine.

2. The method of claim 1, further comprising determining one or more frequencies for the microwaves based on the volumes of the combustion chambers when the engine is to be started.

3. The method of claim 1, wherein the step of determining one or more frequencies is performed by estimating combustion chamber volume and using a look-up table to map volume to frequency.

4. The method of claim 1, wherein the step of determining one or more frequencies is performed by receiving feedback from the antennas.

5. The method of claim 1, wherein the delivering step is performed at least two seconds prior to engine start.

6. The method of claim 1, wherein the delivering step is activated by a fuel pump priming event.

7. A microwave generation system for improving cold starting of an internal combustion engine of a vehicle, the engine having a number of cylinders, the cylinders having combustion chambers, comprising:

at least one microwave generator for generating microwaves at a desired frequency and an antenna for delivering the microwaves into a combustion chamber;

a controller for controlling the generation and delivering of the microwaves such that microwaves are delivered into the combustion chamber immediately prior to cold start of the engine, and for determining one or more frequencies for the microwaves.

8. The system of claim 7, wherein each combustion chamber has an associated microwave generator and antenna.

9. The system of claim 7, wherein the controller determines a frequency for the microwaves delivered to a combustion chamber based on the volume of the combustion chamber when the engine is to be started.

10. The system of claim 7, wherein the controller determines a frequency for the microwaves delivered to a combustion chamber by receiving feedback from the antenna.

* * * * *